US010711710B2

(12) United States Patent
Thommandram et al.

(10) Patent No.: US 10,711,710 B2
(45) Date of Patent: Jul. 14, 2020

(54) REDUCED MATERIAL SPIGOT DESIGN FOR INTEGRATED VDA ADAPTER HOUSING WITH AS-CAST ANTI-ROTATION FEATURE

(71) Applicant: Continental Powertrain USA, LLC, Auburn Hills, MI (US)

(72) Inventors: Giri Thommandram, Chatham (CA); Benjamin Nydam, Chatham (CA); Donald Taylor, Chatham (CA)

(73) Assignee: Continental Powertrain USA, LLC, Auburn Hills, MI (US)

( * ) Notice: Subject to any disclaimer, the term of this patent is extended or adjusted under 35 U.S.C. 154(b) by 0 days.

(21) Appl. No.: 16/361,538

(22) Filed: Mar. 22, 2019

(65) Prior Publication Data

US 2019/0345884 A1 Nov. 14, 2019

Related U.S. Application Data

(60) Provisional application No. 62/668,511, filed on May 8, 2018.

(51) Int. Cl.
*F02D 41/00* (2006.01)
*F02D 9/08* (2006.01)

(52) U.S. Cl.
CPC ..... *F02D 41/0002* (2013.01); *F02D 9/08* (2013.01)

(58) Field of Classification Search
CPC ..... F02D 9/107; F02D 9/1035; F16K 27/218; F16K 27/227
See application file for complete search history.

(56) References Cited

U.S. PATENT DOCUMENTS 5,341,773 A * 8/1994 Schulte ..... F02D 9/105 123/184.61
5,878,715 A * 3/1999 Hernandez ..... F02D 9/02 123/184.61
5,988,131 A * 11/1999 Hernandez ..... F02D 9/1035 123/184.21
6,273,119 B1 * 8/2001 Foster ..... F02D 9/04 137/15.25
6,364,287 B1 * 4/2002 Rauch ..... F02D 9/1065 137/315.22
7,857,359 B2 * 12/2010 Zeitlinger ..... F28F 9/0246 285/182
8,746,210 B2 * 6/2014 Nicholas ..... F02D 9/1065 123/396
9,657,878 B2 * 5/2017 Hartmann ..... F16L 37/0885
(Continued)

*Primary Examiner* — Phutthiwat Wongwian
*Assistant Examiner* — Sherman D Manley

(57) ABSTRACT

A throttle control assembly which includes a housing, and an adapter and an anti-rotation feature integrally formed with the housing. A scallop is integrally formed as part of the housing and substantially surrounds the anti-rotation feature. A first tapered portion and a second tapered portion are both integrally formed with the adapter. A first groove and a rib portion are also integrally formed as part of the adapter. A plurality of outer scallops are also integrally formed as part of the adapter. The anti-rotation feature, the scallop, and each of the plurality of outer scallops are integrally formed with the housing. A portion of the plurality of outer scallops are formed as part of the second tapered portion, and a portion of the plurality of outer scallops are formed as part of the rib portion.

13 Claims, 6 Drawing Sheets

(56) References Cited

U.S. PATENT DOCUMENTS

| | | | | |
|---|---|---|---|---|
| 10,215,105 | B1 * | 2/2019 | Nydam | F02D 9/107 |
| 2002/0185106 | A1 * | 12/2002 | Storz | F02M 35/10144 123/337 |
| 2012/0304964 | A1 * | 12/2012 | Nemoto | F02D 9/10 123/399 |
| 2016/0377001 | A1 * | 12/2016 | Taylor | F02D 9/1035 123/337 |
| 2018/0274402 | A1 * | 9/2018 | Vericker | F01M 11/10 |

* cited by examiner

REDUCED MATERIAL SPIGOT DESIGN FOR INTEGRATED VDA ADAPTER HOUSING WITH AS-CAST ANTI-ROTATION FEATURE

CROSS-REFERENCE TO RELATED APPLICATIONS

This application claims the benefit of provisional application 62/668,511, filed May 8, 2018. The disclosure of the above application is incorporated herein by reference.

FIELD OF THE INVENTION

The invention relates generally to an electronic throttle body having an integrally formed anti-rotation feature, where the anti-rotation feature is formed during a molding or casting process along with several outer scallops to reduce thickness in various areas of the electronic throttle body, therefore reducing porosity.

BACKGROUND OF THE INVENTION

Electronic throttle bodies are generally known, and it is typical for a duct or conduit to be connected to and in fluid communication with the throttle body for directing air into the throttle body, where the throttle body controls the flow of the air into an engine. The conduit is commonly connected to the throttle body through the use of a connector, and the conduit is prevented from rotating relative to the throttle body by some type of anti-rotation feature, which is engaged with the conduit.

Typical throttle bodies have parts which are made as a single component, but certain parts that are formed as part of the throttle body are more complex, and expensive to manufacture. Some of the parts of the throttle body are formed using a casting process, and others are formed using various machining processes. Additional machining processes increase cost, and require additional steps during manufacturing. Some throttle bodies have an anti-rotation feature which is formed during subsequent manufacturing processes, such as machining, or the anti-rotation feature is formed as part of one of several separate components of the throttle assembly, which are assembled together. The use of the subsequent manufacturing processes, or manufacture of several components, increases costs, manufacturing time, and increases the overall complexity of manufacturing the throttle body assembly. Furthermore, throttle body assemblies made of several components assembled together are typically unable to meet stringent packaging requirements.

Some throttle bodies are made using an injection molding process or die casting process, which often results in undesired porosity when metals are used due to the wall thickness of certain parts of the throttle body.

Accordingly, there exists a need for a throttle body which is simpler to manufacture, includes an anti-rotation feature that is formed without the use of additional machining processes, and also includes more or more features that reduce porosity.

SUMMARY OF THE INVENTION

In one embodiment, the present invention is a throttle control assembly which includes a housing, an adapter integrally formed with the housing, and an anti-rotation feature integrally formed with the housing. A scallop is integrally formed as part of the housing, such that the scallop substantially surrounds the anti-rotation feature. A first tapered portion and a second tapered portion are both integrally formed with the adapter.

A first groove is integrally formed as part of the adapter such that the first groove partially circumscribes the adapter, the first groove being adjacent the second tapered portion, and a rib portion is integrally formed as part of the adapter such that the rib portion partially circumscribes the adapter and the rib portion is adjacent the first groove. The throttle control assembly also includes a plurality of outer scallops integrally formed as part of the adapter, and each of the outer scallops includes one of a plurality of sections having reduced thicknesses. In an embodiment, each of the plurality of sections reduces porosity in the adapter, and each of the plurality of sections reduces the amount of cast material and reduces the weight of the throttle control assembly. The reduction in the amount of cast material reduces cost, and the reduction in weight improves fuel economy. The anti-rotation feature, the scallop, and each of the plurality of outer scallops are integrally formed with the housing during a molding process.

In an embodiment, the throttle control assembly also includes a housing portion being part of the adapter, and a central port. Part of the central port extends through the housing portion of the adapter, and part of the central port extends through the housing.

In an embodiment, the throttle control assembly includes a second groove integrally formed as part of the housing such that the second groove partially circumscribes the housing, and the rib portion is disposed between the first groove and the second groove.

In an embodiment, a portion of the plurality of outer scallops are formed as part of the second tapered portion, and a portion of the plurality of outer scallops are formed as part of the rib portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
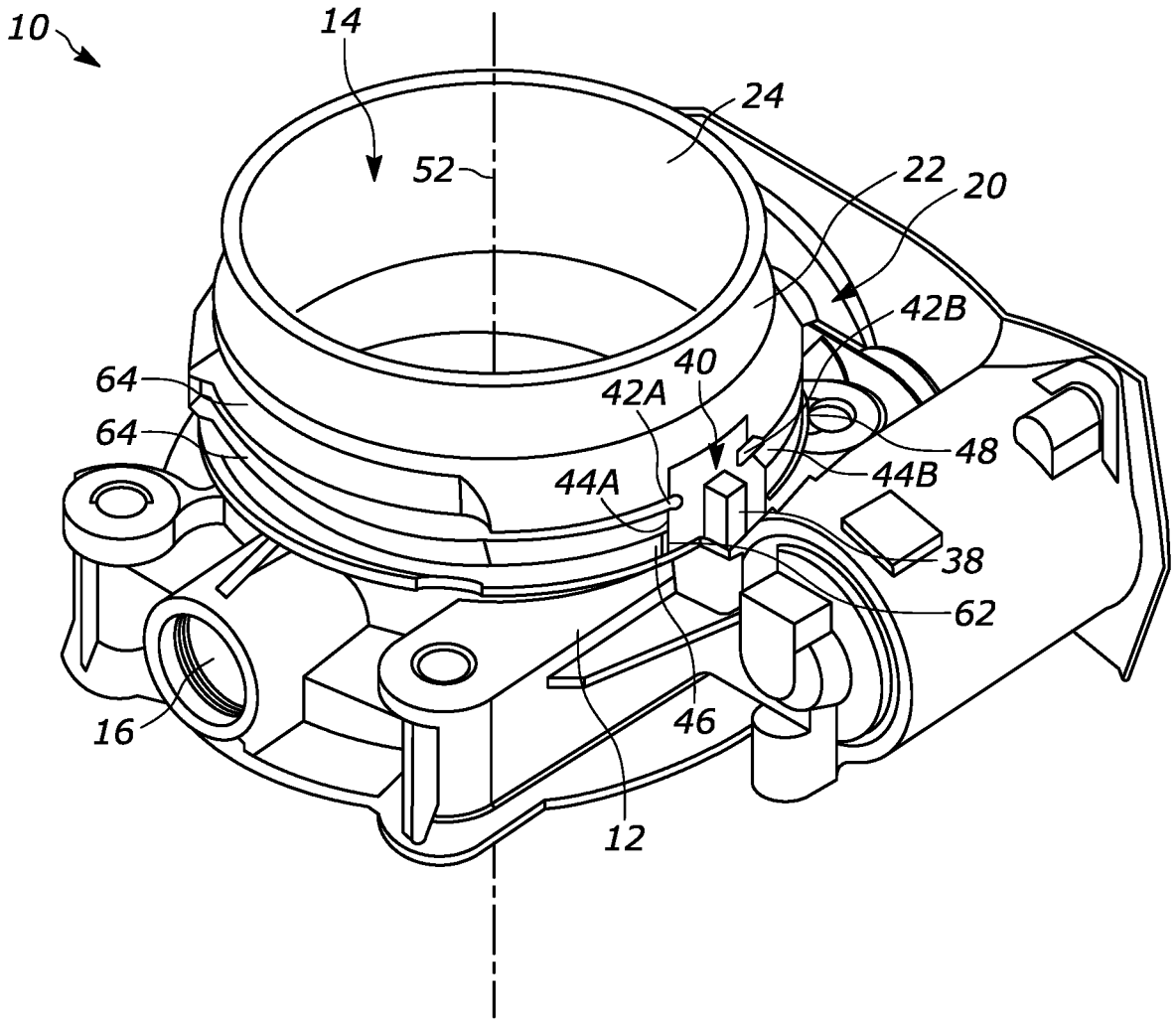
FIG. 1 is a first perspective view of an electronic throttle body having an anti-rotation feature, according to embodiments of the present invention.

The following description of the preferred embodiment(s) is merely exemplary in nature and is in no way intended to limit the invention, its application, or uses.

An electronic throttle control assembly having an integrally formed anti-rotation feature according to the present invention in shown in the Figures generally at 10. The assembly 10 includes a throttle body housing 12, and formed as part of the housing 12 is a central port, shown generally at 14, through which air passes during operation of the assembly 10. There is a shaft (not shown) which extends through part of the central port 14, where the shaft is rotatable, and mounted to the shaft is a valve plate (also not shown).

The shaft is mounted in a bore 16 formed as part of the housing 12. The housing 12 also includes a cavity, and disposed in the cavity is an actuator (not shown). The actuator is used for controlling a gear assembly, which is then connected to the shaft, thereby controlling the position of the valve plate in the central port 14. Changing the position of the valve plate controls the flow of air through the central port 14.

The assembly 10 also includes an adapter, shown generally at 20, where the adapter 20 is suitable for connection with a conduit. The adapter 20 includes a housing portion 22, and formed as part of the housing portion 22 is an aperture 24, which forms part of the central port 14, and is of a substantially constant inner diameter. The remaining part of the central port 14 is formed as part of and extends through the housing 12. The housing portion 22 also includes a first diameter portion 26 which is adjacent a first tapered portion 28. The housing portion 22 also has a second tapered portion 30 which is adjacent the first diameter portion 26. Each of the tapered portions 28,30 facilitate the connection between a conduit and the throttle control assembly 10. During assembly, the housing portion 22 is inserted into an end portion of the conduit, and the tapered portions 28,30 and an anti-rotation feature 38 provide proper alignment between the housing portion 22 and the conduit during the assembly process at the facility where the throttle control assembly 10 is manufactured.

Adjacent the second tapered portion 30 is a first groove 32, adjacent the first groove 32 is a rib portion 34, and adjacent the rib portion 34 is a second groove 36. Integrally formed with the housing 12 and the adapter 20 is the anti-rotation feature 38, which protrudes from the housing 12, and is adjacent the housing portion 22.

Integrally formed with the housing 12 and the adapter 20 is a scallop, shown generally at 40. Part of the scallop 40 is adjacent a first end 42A of the first groove 32, and a first end 44A of the rib portion 34. Part of the scallop 40 is also adjacent a second end 42B of the first groove 32, and a second end 44B of the rib portion 34. An end portion 46 of the second groove 36 also terminates into a lower wall 62, which is adjacent a portion of the scallop 40. The grooves 32,36 and rib portion 34 are also used for connecting the conduit to the assembly 10. The grooves 32,36 are able to receive a snap ring, clip, or some other type of connecting device for securing the conduit to the assembly 10.

The throttle control assembly 10 is formed using various manufacturing processes. The housing 12, second groove 36, anti-rotation feature 38, and scallop 40 are formed during a casting process.

Once the casting process is complete, various portions of the throttle control assembly 10 have yet to be formed. A machining process is then used to form the housing portion 22, the first groove 32, and the rib portion 34. The scallop 40 provides adequate space which allows for various tooling to be used as part of the machining process to form the housing portion 22, the first groove 32, and the rib portion 34. The second groove 36 partially circumscribes the housing 12, and the first groove 32 and the rib portion 34 almost completely circumscribe the housing portion 22, with the exception of the areas occupied by the anti-rotation feature 38 and the scallop 40.

The second groove 36 (formed during the casting process) does not entirely circumscribe the housing 12. An outer portion 48 partially circumscribes the housing 12 in an area along the outside of the housing 12 (where the second groove 36 was not formed during the casting process), such that the outer portion 48 is adjacent a part of the rib portion 34 in a similar manner to the second groove 36. The outer portion 48 is formed during the machining process along with the housing portion 22, the first groove 32, and the rib portion 34. Part of the outer portion 48 extends along the outside of the housing 12 in an area where the portion having the cavity 18 is integrally formed with the housing 12. Another part of the outer portion 48 also extends along the outside of the housing 12 along an area where a gear housing 50 is integrally formed with the housing 12.

An axis 52 extends through the central port 14, and the anti-rotation feature 38 may be formed during the casting process at many possible locations along the outer surface of the housing 12.

Figure 2:
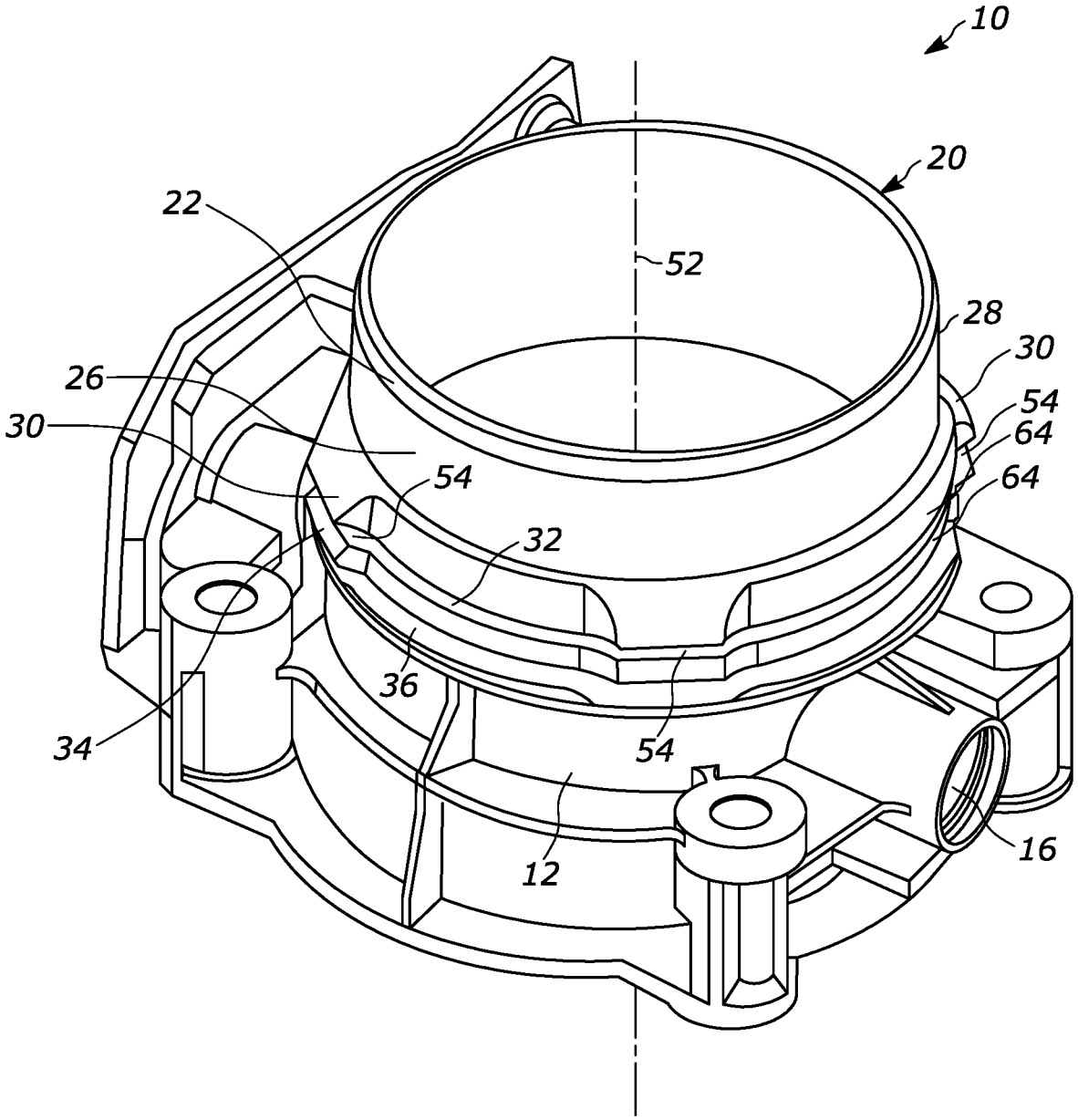
FIG. 2 is a second perspective view of an electronic throttle body having an anti-rotation feature, according to embodiments of the present invention.
Figure 3:
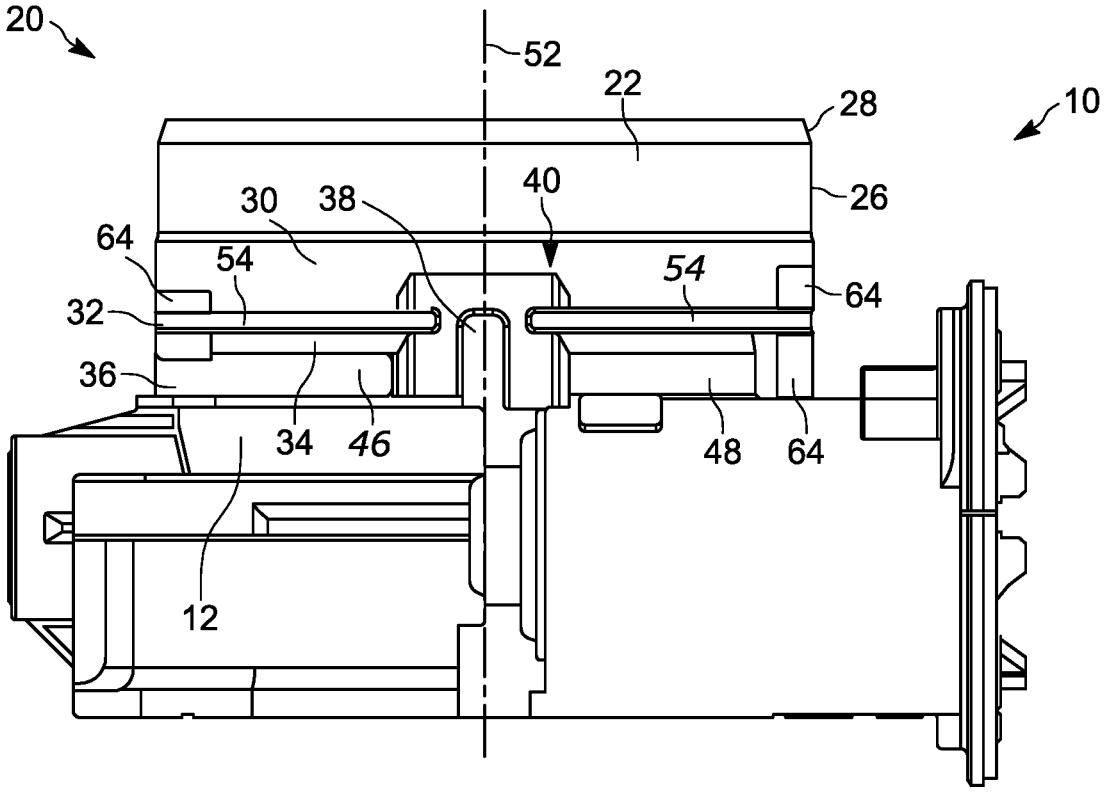
FIG. 3 is a side view of an electronic throttle body having an anti-rotation feature, according to embodiments of the present invention.
Figure 4:
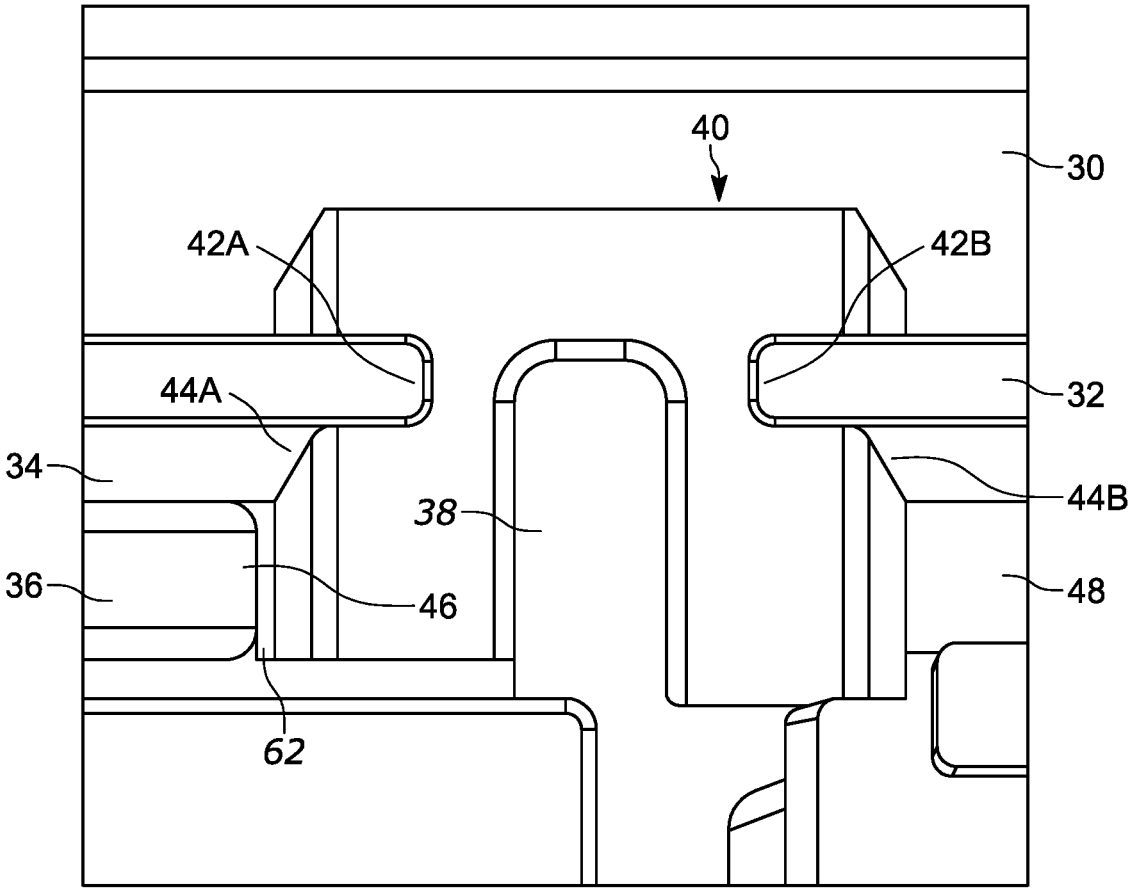
FIG. 4 is an enlarged side view of a portion of an electronic throttle body having an anti-rotation feature, according to embodiments of the present invention.
Figure 5:
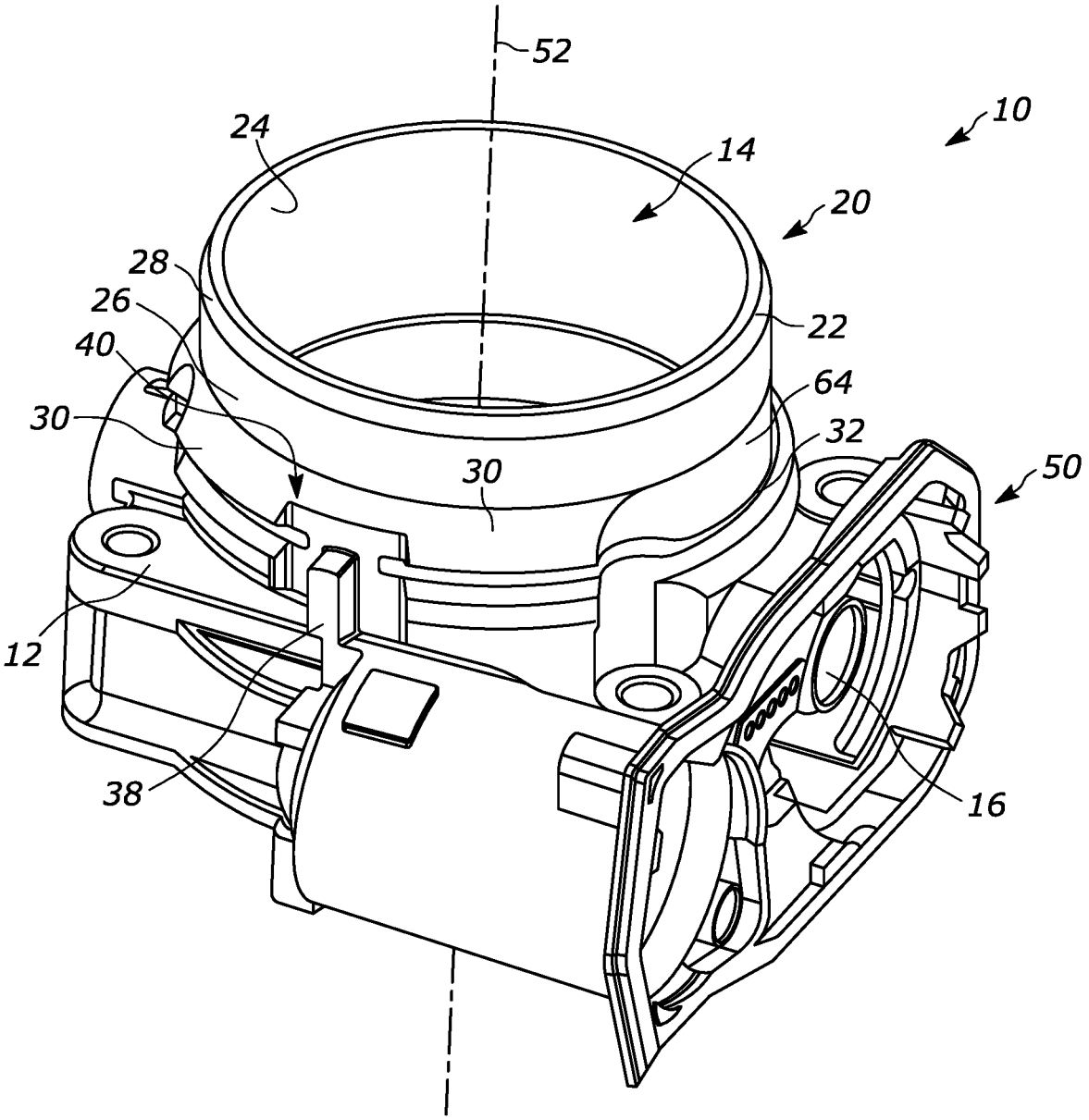
FIG. 5 is a third perspective view of an electronic throttle body having an anti-rotation feature, according to embodiments of the present invention.
Figure 6:
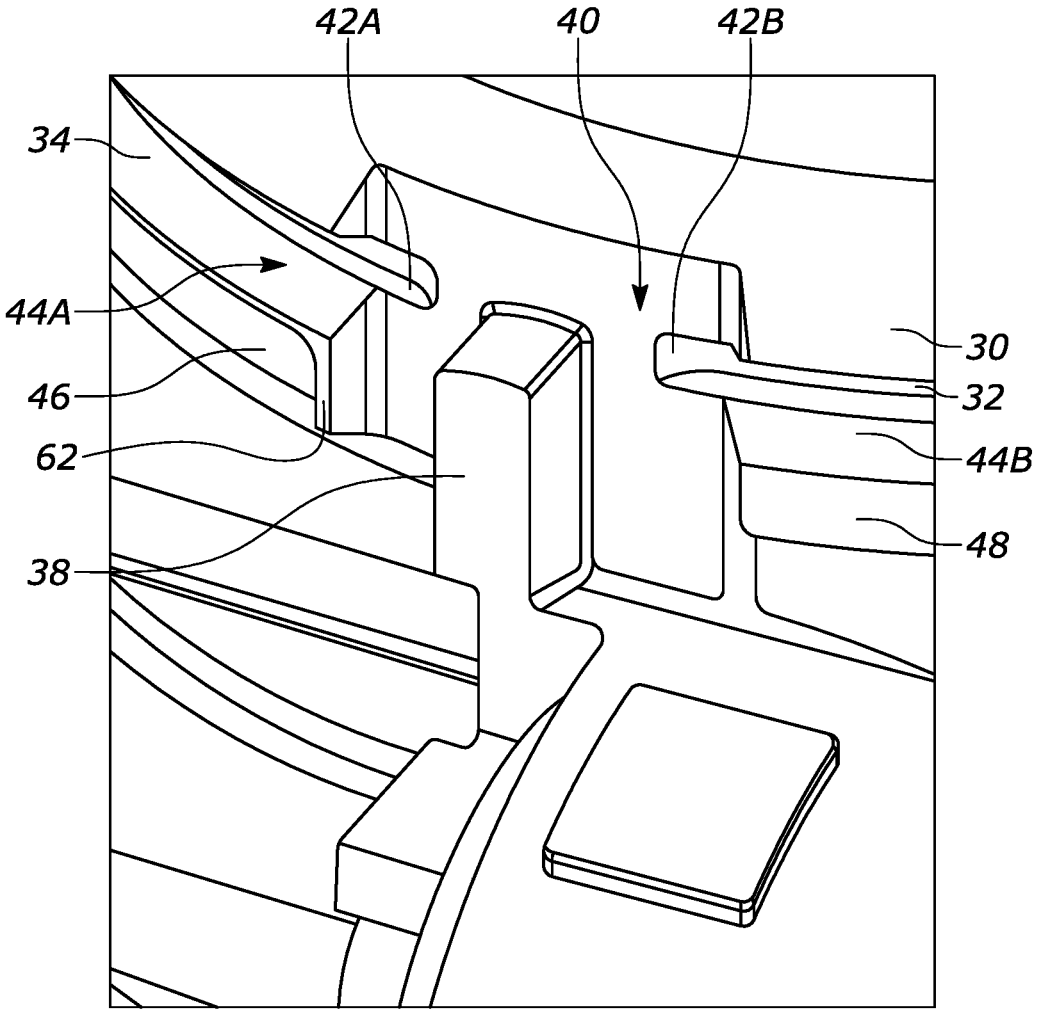
FIG. 6 is an enlarged perspective view of a portion of an electronic throttle body having an anti-rotation feature, according to embodiments of the present invention.

The second tapered portion 30 and the rib portion 34 do not entirely circumscribe the housing portion 22. There are also several outer scallops 64 integrally formed as part of the housing portion 22, as shown in FIGS. 1-2. The outer scallops 64 are formed during the casting process to reduce the thickness of the material in the areas of the second tapered portion 30 and the rib portion 34, which reduces the risk of porosity during casting. The reduction in material used in the areas of the second tapered portion 30 and the rib portion 34 also reduces cost and the overall weight of the throttle control assembly 10.

After the throttle control assembly 10 is formed, there are several spring contact points 54 in the first groove 32 between the second tapered portion 30 and the rib portion 34, where a spring clip (not shown) may be used to connect the conduit to the housing portion 22. The spring contact points 54 are located in areas of the second tapered portion 30 and the rib portion 34 where material still remains after the formation of the outer scallops 64 (i.e., the portions of the second tapered portion 30 and the rib portion 34 where the outer scallops 64 were not formed). In this embodiment, there are four spring contact points 54, but it is within the scope of the invention that the first groove 32 may have more or less spring contact points 54, depending upon how many outer scallops 64 are formed are part of the housing portion 22.

The anti-rotation feature 38 being formed during the casting process, and the entire throttle control assembly 10 being formed as a single component, reduces the number of steps in the manufacturing process of the throttle control assembly 10, reducing manufacturing cost.

Furthermore, the dimensions of the anti-rotation feature 38 may be varied to be suitable for various packaging and design requirements, as well as different types of conduits having different connecting devices.

While it has been described above that the housing 12, second groove 36, anti-rotation feature 38, and scallop 40 are formed during a casting process, it is within the scope of the invention that these components may be formed during other types of processes as well, such as, but not limited to, metal injection molding and 3D printing.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a throttle control assembly, including:

a housing;

an adapter integrally formed with the housing;

an anti-rotation feature integrally formed with the housing;

a scallop integrally formed as part of the housing, such that the scallop substantially surrounds the anti-rotation feature;

a plurality of outer scallops integrally formed as part of the adapter; and a plurality of sections having reduced thicknesses, each one of the plurality of sections being part of a corresponding one of the plurality of outer scallops;

wherein the anti-rotation feature, the scallop, and each of the plurality of outer scallops are integrally formed with the housing during a molding process.

2. The apparatus of claim 1, the adapter further comprising a first tapered portion, wherein the first tapered portion facilitates the attachment of a conduit to the adapter.

3. The apparatus of claim 1, further comprising:

a second tapered portion integrally formed with the adapter;

a first groove integrally formed as part of the adapter, the first groove being adjacent the second tapered portion; and a rib portion integrally formed as part of the adapter such that the rib portion is adjacent the first groove;

wherein the first groove and the rib portion partially circumscribe the adapter.

4. The apparatus of claim 3, further comprising:

a second groove integrally formed as part of the housing such that the second groove is adjacent the rib portion;

wherein the second groove partially circumscribes the housing.

5. The apparatus of claim 1, wherein each of the plurality of sections reduces porosity in the adapter.

6. The apparatus of claim 1, further comprising:

a housing portion being part of the adapter; and a central port;

wherein part of the central port extends through the housing portion of the adapter, and part of the central port extends through the housing.

7. The apparatus of claim 1, wherein a portion of the plurality of outer scallops are formed as part of the second tapered portion.

8. The apparatus of claim 1, wherein a portion of the plurality of outer scallops are formed as part of the rib portion.

9. A throttle control assembly, comprising:

a housing;

an adapter integrally formed with the housing;

an anti-rotation feature integrally formed with the housing;

a scallop integrally formed as part of the housing, such that the scallop substantially surrounds the anti-rotation feature;

a first tapered portion integrally formed with the adapter;

a second tapered portion integrally formed with the adapter;

a first groove integrally formed as part of the adapter such that the first groove partially circumscribes the adapter, the first groove being adjacent the second tapered portion;

a rib portion integrally formed as part of the adapter such that the rib portion partially circumscribes the adapter and the rib portion is adjacent the first groove;

a plurality of outer scallops integrally formed as part of the adapter; and a plurality of sections having reduced thicknesses, each one of the plurality of sections being part of a corresponding one of the plurality of outer scallops;

wherein the anti-rotation feature, the scallop, and each of the plurality of outer scallops are integrally formed with the housing during a molding process.

10. The throttle control assembly of claim 9, wherein each of the plurality of sections reduces porosity in the adapter.

11. The throttle control assembly of claim 9, further comprising:

a housing portion being part of the adapter; and a central port;

wherein part of the central port extends through the housing portion of the adapter, and part of the central port extends through the housing.

12. The throttle control assembly of claim 9, further comprising:

a second groove integrally formed as part of the housing such that the second groove partially circumscribes the housing;

wherein the rib portion being disposed between the first groove and the second groove.

13. The throttle control assembly of claim 9, wherein a portion of the plurality of outer scallops are formed as part of the second tapered portion, and a portion of the plurality of outer scallops are formed as part of the rib portion.

* * * * *